US005415462A

United States Patent [19]

Massa

[11] Patent Number: 5,415,462

[45] Date of Patent: May 16, 1995

[54] ROTATABLE CUTTING BIT AND BIT HOLDER

[75] Inventor: Ted R. Massa, Latrobe, Pa.

[73] Assignee: Kennametal Inc., Latrobe, Pa.

[21] Appl. No.: 227,811

[22] Filed: Apr. 14, 1994

[51] Int. Cl.[6] ..... E21B 10/00

[52] U.S. Cl. ..... 299/86; 299/91

[58] Field of Search ..... 299/86, 91, 92

[56] References Cited

U.S. PATENT DOCUMENTS

| | | | |
|---|---|---|---|
| 3,519,309 | 7/1970 | Engle et al. | 299/86 |
| 3,752,515 | 8/1973 | Oaks et al. . | |
| 3,865,437 | 2/1975 | Crosby | 299/86 |
| 4,201,421 | 5/1980 | Den Besten et al. | 299/86 |
| 4,561,698 | 12/1985 | Beebe | 299/86 |
| 4,603,911 | 8/1986 | Hindmarsh et al. | 299/91 |
| 4,660,890 | 4/1987 | Mills | 299/79 |
| 4,823,454 | 4/1989 | Mills | 29/457 |
| 4,844,550 | 7/1989 | Beebe | 299/92 |
| 4,932,723 | 6/1990 | Mills | 299/86 |
| 5,219,209 | 6/1993 | Pizzi | 299/86 |

FOREIGN PATENT DOCUMENTS

| | | | |
|---|---|---|---|
| 70153 | 12/1975 | Australia | 299/86 |

OTHER PUBLICATIONS

Sandvick Brochure "System 35" 1987.

Block Top-Pocket Saver Literature from All Pacific Distribution (2 pages) (undated).

Spin Shield Literature from All Pacific Distribution (pp. 14 and 16) (undated).

*Primary Examiner*—David J. Bagnell

*Attorney, Agent, or Firm*—John J. Prizzi

[57] ABSTRACT

A rotatable cutting bit for insertion into the bore of a bit holder wherein the cutting bit includes a bit body with opposite forward and rearward ends, a hard insert at the forward end of the bit body, and an enlarged mediate portion which has a rearwardly facing shoulder. The cutting bit further has a rearward shank which contains a reduced diameter portion. The cutting bit carries a rotatable sleeve on the shank whereby the sleeve surrounds the shank between the shoulder and the reduced diameter portion. The cutting bit also carries a rotatable washer on the shank adjacent the shoulder of the bit body. A keeper ring is captive within the reduced diameter portion of the shank.

30 Claims, 4 Drawing Sheets

ROTATABLE CUTTING BIT AND BIT HOLDER

BACKGROUND OF THE INVENTION

The invention concerns a rotatable cutting bit, as well as the bit holder, wherein the cutting bit has a hard insert at the forward end thereof. The cutting bit rotatably mounts in the bit holder. More specifically, the invention pertains to such a rotatable cutting bit, as well as the bit holder, designed so as to exhibit a reduction in the tendency for debris to impede rotation, and thereby provide for improved rotation, between the bit and the bit holder. The invention also provides for a rotatable cutting bit, as well as the bit holder, which provides for improved wear protection for the bit holder during operation.

In the past, rotatable cutting tools have been put to a number of uses, including use as a mine tool in a continuous mining machine. Typically, a continuous mining machine includes a driven rotatable drum having a plurality of support blocks affixed thereto. Each block contains a central bore therein.

Earlier rotatable cutting tools used in continuous mining applications typically comprised an elongate steel body with a hard cemented carbide tip brazed into a socket contained in the forward end of the steel body. The steel body included a reduced diameter portion adjacent the rearward end thereof. A retainer was positioned adjacent the reduced diameter portion of the steel body and functioned to rotatably retain the rotatable cutting tool within the bore of the support block during operation.

In operation, the drum rotated whereby the rotatable cutting tools impacted the earth formation, such as, for example, coal, so as to cut and break up the earth formation. As can be appreciated, the earlier rotatable cutting bits operated in an environment in which small particles of the earth formation impacted by the bit, such as coal, impinged upon the cutting bit. As the length of operation increased, these contaminants or debris had the tendency to become sandwiched between the rotatable cutting bit and the bit holder. If the amount of contaminants or debris became too great, it impeded the rotation of the cutting bit. When the cutting bit failed to rotate or the rotation of the cutting was impeded, the cutting bit experienced premature and uneven wear, which resulted in the shortening of the expected useful life of the cutting bit. It is, therefore, apparent that in light of the past experience of earlier cutting bits, it would be beneficial to provide a rotatable cutting bit which has an improved ability to freely rotate during operation, and furthermore, is less susceptible to debris-generated non-rotation than earlier cutting bits.

During the operation of the earlier cutting bits, the support block experienced wear due to the contact between the cutting bit and the support block, as well as the impingement of the debris from the cutting operation. While the cutting bit was replaced on a periodic basis after the expiration of the useful life thereof, the support block was typically intended to be functional much longer than the cutting bit. As the bore and front face of the support block became worn, the support block lost its effectiveness due to deformation and wear of the bore and the front face thereof. In the case of the bore, it lost its initial cylindrical shape by becoming out-of-round, oversized or bell-mouthed. In the case of the front face of the support block, it lost its flatness.

Each one of these conditions impeded the satisfactory rotation of the cutting bit in the support block.

It would, therefore, be very advantageous to provide a cutting bit which, during operation, protects the bore of the bit holder, as well as the front face of the support block, from deformation. By providing this protection, a cutting bit would help prolong the useful life of the support block, as well as, help the rotation of the cutting bit.

In the past, others have tried to provide for improved rotation of the cutting bit relative to the bit holder. One early patent is U.S. Pat. No. 4,201,421, to DenBesten et al., which discloses a rotatable cutting bit having a split sleeve retainer with or without a collar. According to the DenBesten et al. patent, this style of retainer helps prevent wear between the cutting bit and the bit holder. The DenBesten et al. sleeve does not rotate relative to the cutting bit or the bit holder during operation. Thus, there is only one surface interface which, if clogged with debris, will cause the cutting bit to not rotate.

U.S. Pat. No. 4,561,698, to Beebe, shows a rotatable cutting bit which has a retainer comprising a sleeve and a flange which extends over the face of the support block. Like the retainer of the DenBesten et al. patent, this retainer engages the wall of the bore in the support block so that it does not rotate during operation. Like the cutting bit of DenBesten et al., there is only one surface interface which, if clogged with debris, will cause the cutting bit to not rotate. U.S. Pat. No. 4,844,550, to Beebe, shows a cutting bit like that of the '698 Beebe patent, as well as a retainer comprised of a sleeve and a collar. Neither the sleeve nor the collar appears to rotate during operation of the cutting bit so that the cutting bit of the '550 patent appears to have the same drawbacks as that of the '698 patent.

U.S. Pat. No. 3,865,437, to Crosby, appears to show a cutting bit which is rotatably received by a sleeve. The sleeve is rotatably received in the bore of a support block.

All Pacific Distribution Company, of Anaheim, Calif., has advertised for sale a so-called Spin-Shield. According to the advertisement, the Spin-Shield appears to be made of hard material and rests between the cutting bit and the block. The shield protects the face of the support block from wear. U.S. Pat. Nos. 4,660,890 and 4,823,454, to Mills, appear to show a shield which protects the face of the support block during operation. These patents also discuss the Spin-Shield structure.

In trying to design a cutting bit-bit holder assembly, one should try to stay within the basic dimensional boundaries, i.e., the design envelope, defined by the volume of the earlier cutting bit-bit holder assemblies. This restriction regarding the design envelope is important so that there exists compatibility with the existing continuous mining machines. Furthermore, it is advantageous to maintain the current design envelope in order to not impede the flow of cuttings or debris produced during the cutting operation. This restriction regarding the design envelope, however, results in certain drawbacks in the earlier assemblies.

For example, FIG. 1 of the present application shows an earlier cutting bit-bit holder assembly that comprises a support block with a thick rotatable sleeve having a thick axially forward flange. A cutting bit is within the bore of the sleeve. In this assembly, the sleeve rotates relative to the support block and the cutting bit.

Because the sleeve is thick, the thickness of the material in the support block providing support for the bore must be reduced so as to maintain the design envelope. As a consequence, there is less material to support the cutting bit within the support block which weakens the support to the cutting bit provided by the support block.

Because the flange of the sleeve is thick, there is an increase in the distance between the tip of the cutting bit and the face of the support block. This increase in distance causes excessive loading forces on the support block during operation.

As another example, FIG. 2 of the present application shows an earlier cutting bit assembly that comprises a bit holder which comprises a support block, a bushing pressed into the bore of the support block, and a replaceable sleeve within the bore of the bushing. The cutting bit is within the bore of the sleeve. The sleeve rotates with respect to the cutting bit and the bushing.

Like for the example of FIG. 1, because the combined thickness of the sleeve and the bushing is relatively large, the thickness of the material in the support block providing support for the cutting bit must be reduced so as to maintain the design envelope. As a consequence, there is less material to support the cutting bit, which weakens the support provided by the support block.

Because the flange of the sleeve is thick, there is an increase in the distance between the tip of the cutting bit and the face of the support block. Like the example of FIG. 1, this increase in distance causes excessive loading forces on the support block during operation.

It can thus be appreciated that earlier cutting bits, and bit holders, have suffered from disadvantages associated with the exertion of excessive loading forces on an already weakened support block. It would, therefore, be advantageous to provide a rotatable cutting bit, and bit holder, that reduces the above-mentioned drawbacks and also provides for improved rotational characteristics, deformation resistance, and wear resistance.

SUMMARY OF THE INVENTION

It is an object of the invention to provide a rotatable cutting bit, and rotatable cutting bit-bit holder assembly, that has improved wear resistance characteristics for the bit holder.

It is an object of the invention to provide a rotatable cutting bit, and rotatable cutting bit-bit holder assembly, that has improved rotational characteristics during operation.

It is also an object of the invention to provide a rotatable cutting bit, and rotatably cutting bit-bit holder assembly, that is within the design envelope of current assemblies without weakening the support block.

It is also an object of the invention to provide a rotatable cutting bit, and rotatably cutting bit-bit holder assembly, that is within the design envelope of current assemblies without lengthening the distance between the tip and the face of the support block.

In one form thereof, the invention is a rotatable cutting bit for insertion into the bore of a bit holder wherein the rotatable cutting bit comprises a bit body with opposite forward and rearward ends, a hard insert at the forward end of the bit body, and an enlarged diameter portion mediate of the forward and the rearward ends of the bit body. The enlarged diameter portion defines an axially rearwardly facing shoulder. The bit body has a shank, located axially rearwardly of the shoulder, which contains a reduced diameter portion near the rearward end of the body. The cutting bit further includes a rotatable sleeve which surrounds the shank between the shoulder and the reduced diameter portion, and a rotatable washer on the shank adjacent the shoulder of the bit body. A keeper ring is within the reduced diameter portion of the shank.

In another form thereof, the invention is a rotatable cutting bit and bit holder assembly comprising a bit holder which has a bore with axially forward and rearward ends wherein a front face surrounds the axially forward end of the bore. The rotatable cutting bit comprises a body with opposite forward and rearward ends, a hard insert at the forward end of the body, and an enlarged diameter portion mediate of the forward and the rearward ends of the body which defines an axially rearwardly facing shoulder. The body has a shank, located axially rearwardly of the shoulder, which contains a reduced diameter portion near the rearward end of the body. The cutting bit includes a rotatable cylindrical sacrificial sleeve carried on the shank wherein the sleeve is rotatable with respect to the bit holder and the rotatable cutting bit. The cutting bit also has a flat sacrificial washer carried on the shank wherein the washer is rotatable with respect to the bit holder and the rotatable cutting bit. The cutting bit also has a keeper ring, located within the reduced diameter portion of the shank, which engages the bit holder so as to rotatably retain the rotatable cutting bit within the bore of the bit holder.

In still another form, the invention is a rotatable cutting bit and bit holder assembly which comprises a bit holder with a bore and a front face surrounding the axially forward end of the bore. The rotatable cutting bit includes a body with opposite forward and rearward ends, a hard insert at the forward end of the body, and an enlarged diameter portion mediate of the forward and the rearward ends of the body which defines an axially rearwardly facing shoulder. The body has a shank which is axially rearwardly of the shoulder and contains a reduced diameter portion near the rearward end of the body. The cutting bit has a freely rotatable protector on the shank wherein the protector is rotatable with respect to the bit holder and the rotatable cutting bit. The protector has a sleeve portion that surrounds a portion of the shank of the body, and the protector further includes a washer portion between the shoulder and the axially forward face of the bit holder. The cutting bit has a keeper ring rotatably captive within the reduced diameter portion of the shank so as to engage the bit holder and thereby retain the rotatable cutting bit within the bore of the bit holder.

In another form, the invention is a bushing for insertion into the bore of a support block and for holding a rotatable cutting bit with a shank that carries a retainer and a sleeve. The bushing comprises an elongate bushing body which contains a bushing bore therein, wherein the bushing bore has an abutment projecting radially inwardly therein. Upon the positioning of the cutting bit within the bushing bore, the abutment engages the retainer so as to retain the cutting bit within the bushing bore and the abutment engages the sleeve so as to restrict the axially rearward movement of the sleeve.

In still another form, the invention is a protector for carriage by the shank of a rotatable cutting bit which is within the bore of a bit holder. The protector comprises a sleeve portion which surrounds a portion of the shank of the cutting bit and is freely rotatable with respect to the bit holder and the cutting bit so as to provide a barrier between the bit holder and the cutting bit, thereby reducing wear on the bore of the bit holder and two surfaces of rotation between the cutting bit and the bit holder. The protector further comprises a washer portion, located adjacent the face of the bit holder, which defines the forward mouth of the bore, which is freely rotatable with respect to the bit holder and the cutting bit, so as to provide a barrier between the bit holder and the cutting bit, thereby reducing wear on bit holder and two surfaces of rotation between the cutting bit and the bit holder.

BRIEF DESCRIPTION OF THE DRAWINGS

The following is a brief description of the drawings which make up a part of this patent application. A more detailed description of these drawings will follow in the detailed description of the embodiments.

DETAILED DESCRIPTION OF SPECIFIC EMBODIMENTS

Figure 1:
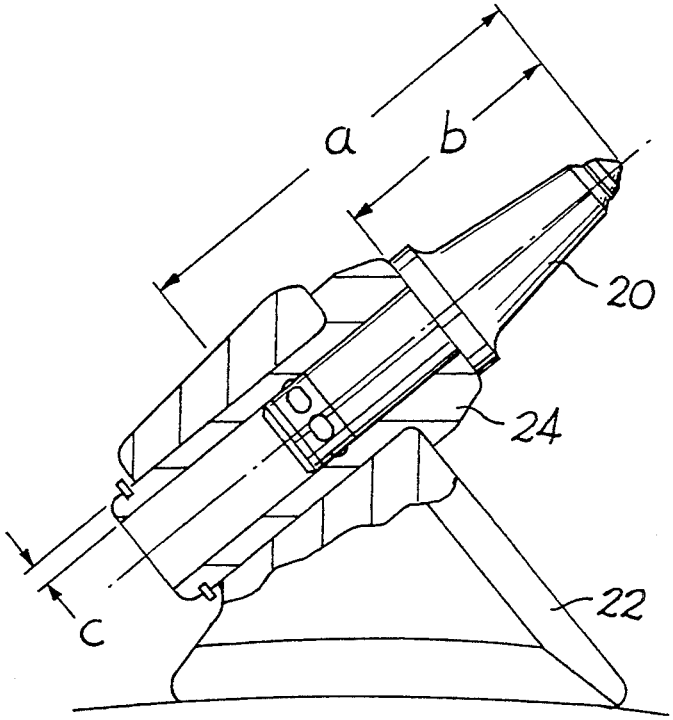
PRIOR ART FIG. 1
FIG. 1 is a side view of one prior art rotatable cutting bit and bit holder comprising a support block and a sleeve wherein the cutting bit is within the bore of the sleeve, and the sleeve and a portion of the support block are shown in cross-section.
Figure 2:
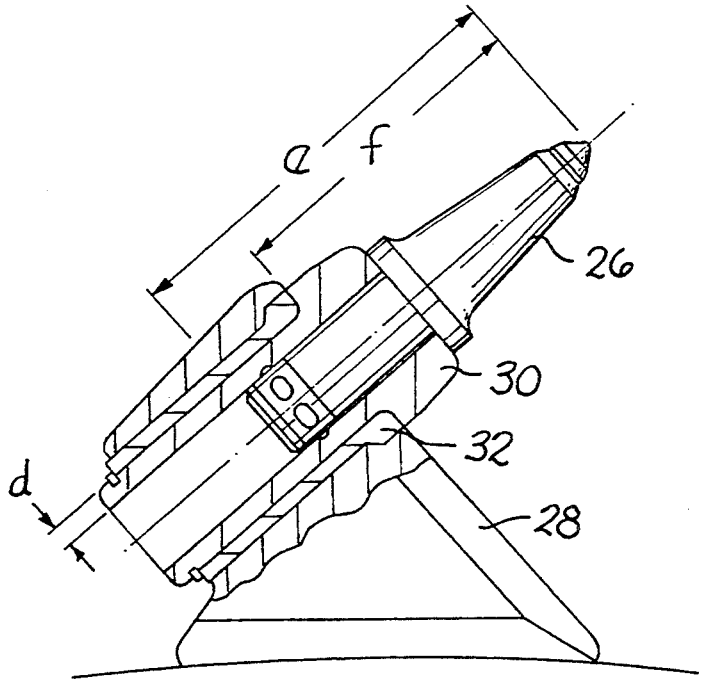
PRIOR ART FIG. 2
FIG. 2 is a side view of another prior art rotatable cutting bit shown positioned within the bore of the bit holder comprising a pressed-in bushing, a sleeve and a support block wherein the cutting bit is within the bore of the sleeve, and the sleeve, bushing and a portion of the support block are shown in cross-section.

Referring to the drawings, FIGS. 1 and 2 illustrate two prior art rotatable cutting bits. FIG. 1 shows a rotatable cutting bit 20 and a support block 22. The support block 22 has a bore which receives a sleeve 24. The sleeve 24 has a bore which receives the rotatable cutting bit 20. The sleeve 24 is rotatable with respect to the bore of the support block 22. The rotatable cutting bit is rotatable with respect to the bore of the sleeve 24.

The dimension "a" is the overall length of the cutting bit 20. The dimension "b" is the distance from the axially forward end of the cutting bit to the front face of the support block. It can be seen that the ratio of the distance from the cemented carbide insert to the front face of the support block "b" is over three-fourths of the axial length "a" of the cutting bit due to the thickness of the flange of the sleeve. Because of this high ratio b/a, meaningful loading forces are exerted on the support block during operation.

The dimension "c" is the thickness of the sleeve 24. This thickness "c" is such so as to require the removal of material from the support block 22 to accommodate the sleeve 24 and remain within the initial design envelope. The removal of material from the support block weakens the support block.

FIG. 2 shows a rotatable cutting bit 26 and a support block 28. The support block 28 has a bore which receives a bushing 32. The bushing 32 has a bore which receives a sleeve 30. The sleeve 30 has a bore which receives the rotatable cutting bit 26. The bushing 32 is press fit into the bore of the support block. The sleeve 30 is rotatable with respect to the bore of the bushing 32. The rotatable cutting bit is rotatable with respect to the bore of the sleeve 30.

The dimension "d" is the total thickness of the bushing and the sleeve 24. This thickness "d" is such so as to require the removal of material from the support block 28 to accommodate the bushing and the sleeve and still remain within the initial design envelope. The removal of material from the support block weakens the support block.

The dimension "e" is the overall length of the cutting bit 26. The dimension "f" is the distance from the axially forward end of the cutting bit to the front face of the support block. Like for the earlier structure of FIG. 1, the ratio of f/e is over three-fourths due to the thickness of the flange of the sleeve 30. The result is that there are meaningful loading forces exerted on the support block during operation.

Figure 3:
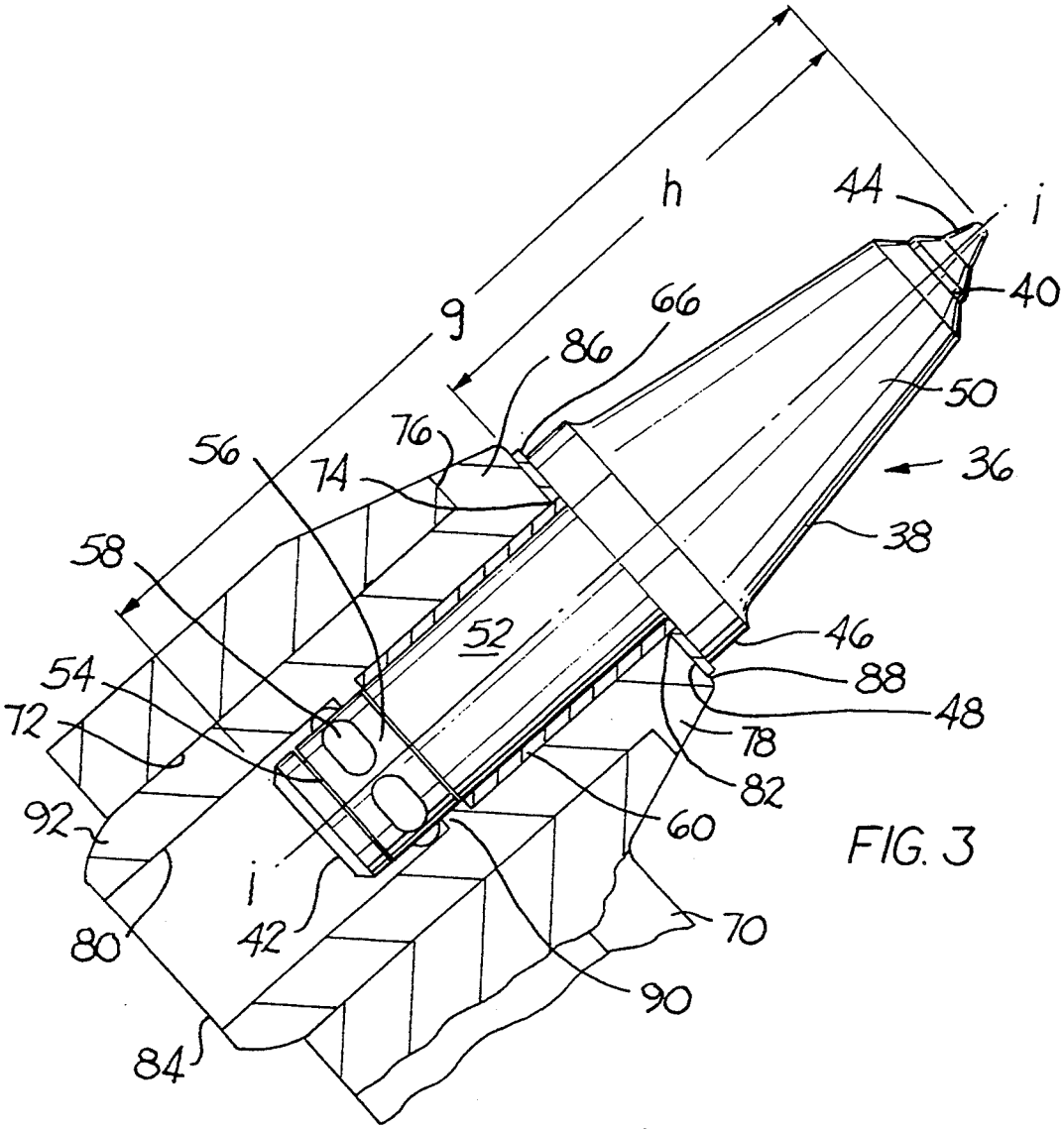
FIG. 3 is a side view of one embodiment of the rotatable cutting bit and bit holder assembly of the invention wherein the sleeve, the washer, and a portion of the bit holder assembly are shown in cross-section.

Referring to the specific embodiment of the invention illustrated in FIG. 3, there is a rotatable cutting bit generally designated as 36. Cutting bit 36 has a bit body 38 with opposite axially forward 40 and rearward 42 ends. A cobalt cemented tungsten carbide insert 44 is at the forward end 40 of the bit body 38. Typically, one affixes the cemented carbide insert 44 to the bit body 38 by brazing the insert in a socket (not illustrated) in the forward end of the bit body. U.S. Pat. No. 5,219,209, to Prizzi et al., (owned by the assignee of the present patent application) shows typical insert configurations and ways to affix the insert to the bit body. Typical grades of cobalt cemented tungsten carbide and braze alloys are also set forth in U.S. Pat. No. 5,219,209.

The bit body 38 further includes an enlarged diameter portion 46 located mediate of the forward end 40 and rearward end 42 thereof. The enlarged diameter portion 46 has a rearwardly facing shoulder 48 which is generally perpendicular to the longitudinal axis i—i of the bit body 38. The portion of the bit body 38 axially forward of the enlarged diameter portion 46 is the nose 50. The portion of the bit body 38 axially rearward of the enlarged diameter portion 46 is the shank 52. The shank 52 has a reduced diameter portion 54 near the rearward end 42 of the bit body 38. The reduced diameter portion of the shank holds a resilient keeper ring 56, which has radially outwardly projecting protrusions 58, captive therein. U.S. Pat. No. 3,519,309, to Engle et al., and U.S. Pat. No. 3,752,515, to Oakes et al., depict certain versions of the resilient keeper ring. The keeper ring 56 is free to rotate relative to the bit body 38.

Figure 4:
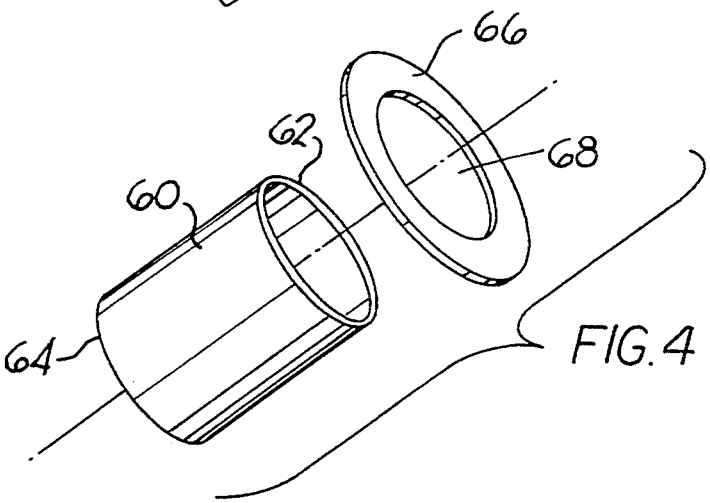
FIG. 4 is a perspective view of the sleeve and the washer of the embodiment of FIG. 3.

Referring to FIGS. 3 and 4, rotatable cutting bit 36 further includes an elongate cylindrical sleeve 60 which has opposite forward 62 and rearward 64 ends. The sleeve 60 is shown as being solid, but it should be understood that the sleeve could have a slit, such as, for example, a longitudinal slit, therein. The specific embodiment of FIGS. 3 and 4 further shows a flat circular washer 66 with a central circular aperture 68. The sleeve 60 passes through the aperture 68 of the washer 66 and abuts against the shoulder 48.

The specific embodiment of FIG. 3 further includes a support block 70 which has a bore 72. Typically, the support block is affixed, such as by welding, to a driven drum. The driven rotatable drum is a part of an apparatus, such as, for example, a continuous mining machine, which powers the drum.

The bore 72 has opposite forward 74 and rearward ends. The support block 70 includes a front face 76 at the forward end 74 of the bore 72. A bushing 78 is press-fit within the bore 72 of the support block. Bushing 78 has a bore 80 with opposite forward 82 and rearward 84 ends. The bushing 78 includes a flange 86 at the forward end 82 thereof. The flange has a front face 88. The bore 80 of the bushing 78 includes an annular abutment 90. The exterior surface of the bushing is tapered radially inwardly at 92 near the axially rearward end 84 so as to facilitate the insertion of the bushing 78 into the bore of the support block 70. The bushing is made from a material that is harder than the material from which the support block is made. By making the bushing from harder material, one achieves the advantages, e.g., longer useful life, of a harder material without the additional expense of making the entire support block from the harder material.

Dimension "g" is the overall length of the cutting bit 36. Dimension "h" is the distance from the cemented carbide insert to the front face of the bushing. The ratio of h/g is less than three-fourths, so that the loading forces exerted upon the support block during operation are less than for earlier assemblies.

In regard to the assembly of the specific embodiment, one press fits the bushing 78 within the bore 72 of the support block 70 so that it is secure therein, whereby the flange 86 rests on the front face 76 of the support block 70. One then inserts the cutting bit into the forward end of the bushing bore 80 until the point where the protrusions 58 on the keeper ring 56 are axially rearward of the abutment 90. In practice, upon the protrusions engaging the abutment, the keeper ring will compress radially inwardly to permit the cutting bit to move farther into the bore. The washer and the shoulder abut against the front face 88 of the bushing 78 to limit the inward insertion of the cutting bit 36 in the bushing bore 80.

The sleeve 60 is rotatable on the shank 52 of the cutting bit body and within the bushing because the sleeve has an outside diameter, which is of a dimension less than the dimension of the diameter of the bushing bore, and the inside diameter of the sleeve is larger than the diameter of the shank. In other words, sleeve 60 is rotatable with respect to both the shank 52 of the cutting bit and the bushing 78. Once the cutting bit is inserted into the bushing bore 80, the axially forward movement of the sleeve 60 is limited by the shoulder 48 in that the forward end 62 of the sleeve 60 abuts the shoulder 48, and the axially rearward movement of the sleeve is limited by the rearward end 64 of the sleeve 60 abutting against the abutment 90.

The washer 66 is rotatable relative to the cutting bit 36, and in particular, to the shoulder 48. The washer 66 is also rotatable with respect to the bushing 78, and in particular, the front face 88 of the bushing. Once the cutting bit is inserted into the bushing bore 80, the axially forward movement of the washer 66 is limited by the shoulder, and the axially rearward movement of the washer is limited by the front face 88 of the bushing.

Because the sleeve and the washer are relatively thin, their use requires the removal of less material from the structure (i.e., the support block alone or in combination with the bushing, which supports the cutting bit) than the prior art. Thus, the present invention remains within the design envelope while actually increasing the volume of material which supports the cutting bit.

The fact that the sleeve and washer are thin also reduces the distance between the tip and the face of the support block so that the present invention remains within the design envelope without resulting in the exertion of excessive loading forces on the support block.

The cutting bit is used to impinge an earth formation and break it into pieces. During the impingement process, there are generated pieces of many different sizes, including particles of a fine size. These fine size particles are known as debris. The debris has the tendency to accumulate between adjacent moving surfaces, such as, for example, the rotational surfaces between the bit body and the support block. The typical result of this accumulation is that the adjacent members no longer move, i.e., rotate. Non-rotation of the cutting bit leads to very uneven wear on the cemented carbide insert, and very possibly a premature failure of the cutting bit. Non-rotation can also cause detrimental wear to the support block.

In operation, a driven drum, to which the support block is affixed, is rotated so as to drive the cemented tungsten carbide insert into the earth formation. The cutting bit is oriented relative to the block so as to be driven into the earth formation at an appropriate angle of attack.

The impingement of the cutting bit on the earth formation causes the cutting bit to rotate about its longitudinal axis i—i, which evenly distributes the wear on the cemented carbide insert, thereby prolonging the useful life of the cutting bit. The impingement also breaks up the earth formation, thereby creating debris which, as previously mentioned, can accumulate between the cutting bit and the support block.

In this specific embodiment, the washer rotates relative to the bit body and the bushing, and thus, there are two locations, or surfaces, of relative movement between the washer and the other structure of the assembly. As a consequence, the debris must accumulate at two locations; namely, between the washer and the cutting bit, and between the washer and the front face of the bushing, before the accumulation can prevent rotation. By requiring accumulation of debris at two locations rather than one, the present cutting bit reduces the potential for non-rotation due to accumulation of debris.

In this specific embodiment, the sleeve also rotates relative to the bit body and the bushing, and thus, there are two locations or surfaces of relative movement between the sleeve and the other structure of the assembly. As a consequence, the debris must accumulate at two locations; namely, between the sleeve and the shank of the cutting bit, and between the sleeve and the bore of the bushing, before the accumulation prevents rotation. By requiring accumulation of debris at two locations rather than one, the present cutting bit reduces the potential for non-rotation due to accumulation of debris.

Once the cutting bit has been operated to achieve its useful life, the cutting bit will be removed from the bit holder and a new cutting bit inserted in its place. Because the new cutting bit carries a new sleeve and washer, there is no carry over of accumulated debris between the cutting bit and the bushing and the sleeve and washer. The absence of any accumulation enhances the rotational and protective features of the assembly.

The sleeve 60 comprises a material that is significantly softer than the bit body and the bushing so that, during operation, the sleeve functions in a sacrificial fashion. The washer comprises a material that is significantly softer than the bit body and the bushing so that, during operation, the washer functions in a sacrificial fashion. Furthermore, it is contemplated that the washer can be softer than the sleeve.

In this regard, the sleeve and the washer could be made from AISI grade 4140 steel with a hardness in the range of 35 to 40 Rockwell C. The bit body could be made from AISI grade 15B35 steel with a hardness within the range of 40 to 45 Rockwell C. The bushing could be made from German steel grade X19NiCrMo4 with a hardness within the range of 48 to 52 Rockwell C. The support block could be made from German steel grade 17CrNiMo06 with a hardness of between 40 to 45 Rockwell C.

In this embodiment, the cutting bit finds support in the combination of the support block and the bushing so that the bit holder structure comprises the combination of the support block and bushing. The bit holder structure could also comprise the support block alone where there was no bushing structure.

Figure 5:
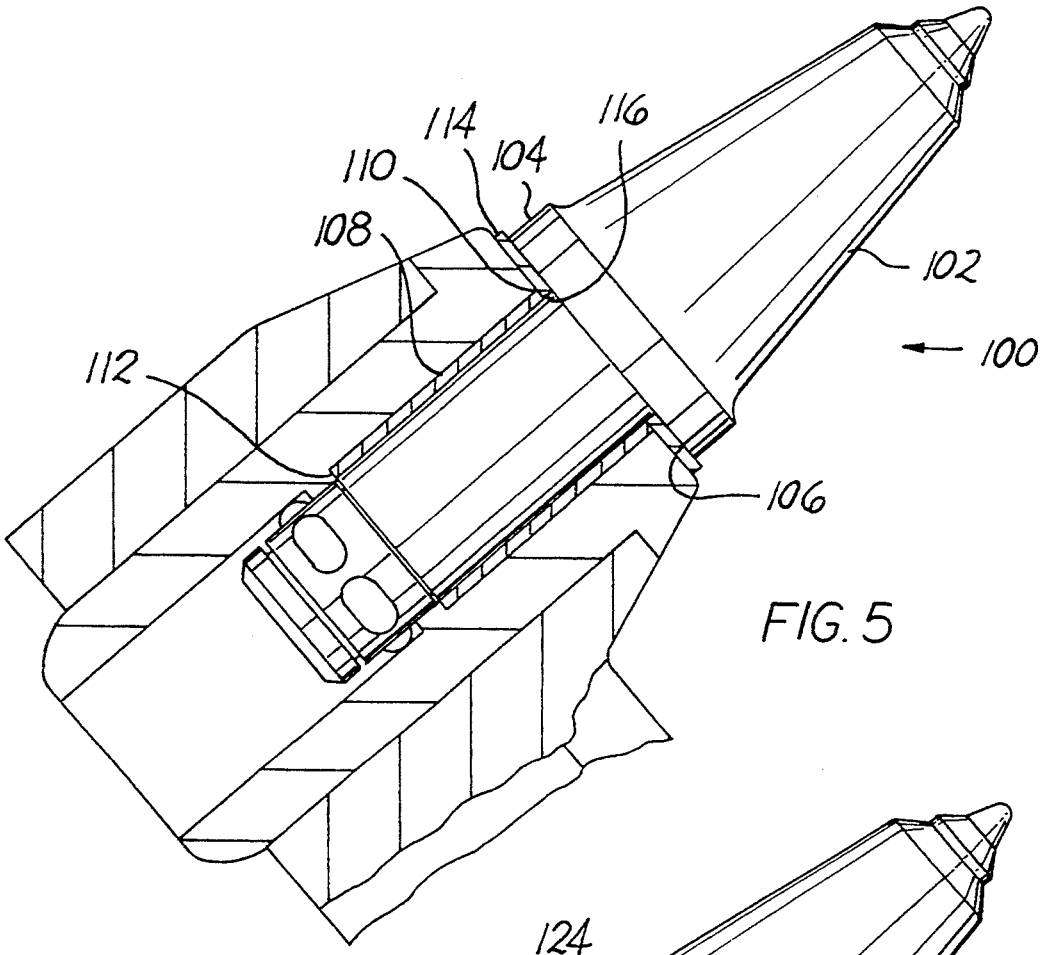
FIG. 5 is a side view of another embodiment of the rotatable cutting bit and bit holder assembly of the invention wherein the sleeve, the washer, and a portion of the bit holder assembly are shown in cross section.

Referring to the specific embodiment of the invention illustrated in FIG. 5, there is a rotatable cutting bit generally designated as 100. The structure of the rotatable cutting bit 100 is exactly like that of cutting bit 36, except for the structure of the sleeve and washer. Thus, the following description will not identify all of the structural features with reference numerals.

Referring to FIG. 5, the cutting bit 100 has a bit body 102 with opposite axially forward and rearward ends wherein there is a cobalt cemented tungsten carbide insert affixed at the forward end by brazing. The bit body 102 further includes an enlarged diameter portion 104 located mediate of the forward end and rearward end thereof. The enlarged diameter portion has a rearwardly facing shoulder 106 which has a surface generally perpendicular to the longitudinal axis of the bit body 102.

The portion of the bit body 102 axially forward of the enlarged diameter portion is the nose. The portion of the bit body 102 axially rearward of the enlarged diameter portion is the shank. The shank has a reduced diameter portion near the rearward end of the bit body 102. The reduced diameter portion of the shank holds a resilient keeper ring, with radially outwardly projecting protrusions, rotatably captive therein.

The specific embodiment of FIG. 5 further includes a sleeve 108 which has opposite forward 110 and rearward 112 ends. The specific embodiment of FIG. 5 further shows a washer 114 with a central aperture 116. The structure of the support block and the bushing are exactly like those for the embodiment shown in FIG. 3. Applicant points out that FIG. 5 does not illustrate the rearward portion of the support block and the bushing. However, the bushing extends rearwardly of the support block like for the embodiment of FIG. 3.

Like for the embodiment of FIG. 3, because the sleeve and the washer are relatively thin, their use does not require removal of material from the support block or the lengthening of the distance between the tip and the face of the support block. Thus, the present invention remains within the design envelope without compromising on the strength of the support block or exerting excessive loading forces on the support block.

Referring to the operation of cutting bit 100, the ability of the sleeve and washer to rotate relative to both the bit body and the bushing exist, and thus, provide the same advantages as provided by the cutting bit 36. The only difference is that the forward end 110 of the sleeve 108 abuts against the washer 114; however, there still remains a barrier of softer material between the bit body and the bushing so that the protective features still remain for the FIG. 5 embodiment. There also remain two surfaces relative to which the sleeve and the washer rotate so that the rotation-promoting features remain for cutting bit 100.

The washer 114 is maintained on the shank of the cutting bit 100 during storage, which is typically in a bucket, by the sleeve and the shoulder. This is, of course, an advantage because the washers do not become separated from the cutting bits during storage.

Figure 6:
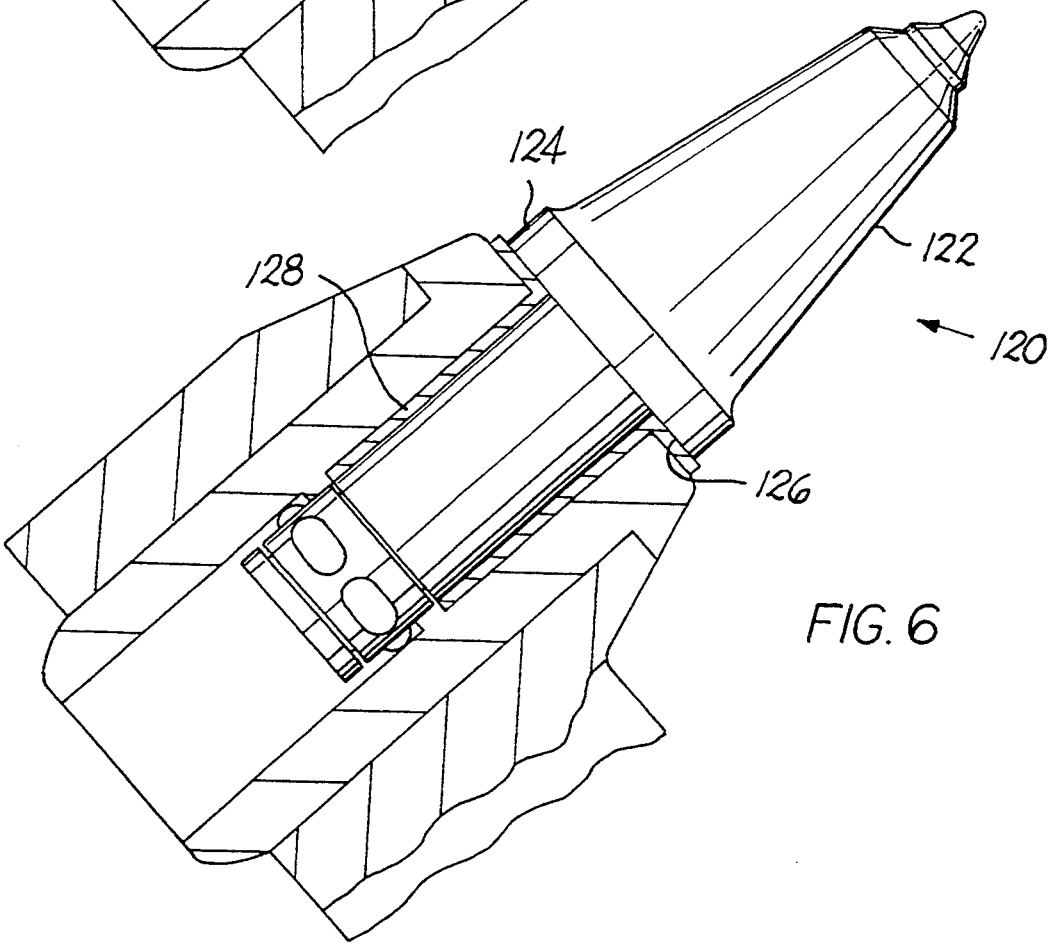
FIG. 6 is a side view of another embodiment of the rotatable cutting bit and bit holder assembly of the invention wherein the protector and a portion of the bit holder assembly are shown in cross-section.
Figure 7:
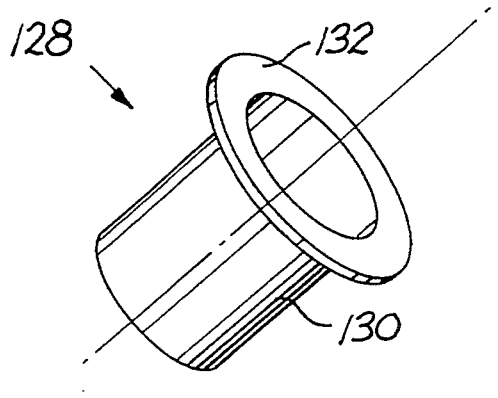
FIG. 7 is a perspective view of the protector of the embodiment of FIG. 6.

Referring to the specific embodiment of the invention illustrated in FIGS. 6 and 7, there is a rotatable cutting bit generally designated as 120. The structure of the rotatable cutting bit 120 is exactly like that of cutting bit 36, except for the structure of the sleeve and washer. Thus, the following description will not identify all of the structural features with reference numerals.

Very briefly, the cutting bit 120 has a bit body 122 with opposite axially forward and rearward ends wherein there is a cobalt cemented tungsten carbide insert affixed at the forward end by brazing. The bit body 122 further includes an enlarged diameter portion 124 located mediate of the forward end and rearward end thereof. The enlarged diameter portion 124 has a rearwardly facing shoulder 126 which has a surface generally perpendicular to the longitudinal axis of the bit body 122. The portion of the bit body 122 axially forward of the enlarged diameter portion is the nose. The portion of the bit body 122 axially rearward of the enlarged diameter portion is the shank. The shank has a reduced diameter portion near the rearward end of the bit body 122. The reduced diameter portion of the shank holds a resilient keeper ring, which has radially outwardly projecting protrusions, rotatably captive therein.

Referring to FIGS. 6 and 7, the cutting bit 120 further has a protector 128 which comprises an integral sleeve portion 130 and an integral washer portion 132. The position of the protector 128 is similar to the position of the sleeve and the washer of the embodiment of FIG. 3 so that the protector 128 provides the same rotational and protective features for cutting bit 120 as do the sleeve and washer of cutting bit 36. The protector is made from material that is much softer than either the cutting bit body or the bushing so that the protector is sacrificial.

The structure of the support block and the bushing are exactly like those for the embodiment shown in FIG. 3. Applicant points out that FIG. 6 does not illustrate the rearward portion of the support block and the bushing. However, the bushing extends rearwardly of the support block like the embodiment of FIG. 3.

Like for the embodiment of FIG. 3, because the protector is relatively thin, its use does not require removal of material from the support block or the lengthening of the distance between the tip and the face of the support block. Thus, the present invention remains within the design envelope without compromising on the strength of the support block or exerting excessive loading forces on the support block.

Referring to the operation of cutting bit 120, the ability of the protector to rotate relative to both the bit body and the bushing exist, and thus, provide the same advantages as provided by the cutting bit 36. The difference is that the protector is one piece as opposed to two separate pieces. There still remains a barrier of softer material between the bit body and the bushing so that the protective features remain for the protector of FIGS. 6 and 7. There also remain two surfaces relative to which the protector rotates that the rotation-promoting features remain for cutting bit 120.

Figure 8:
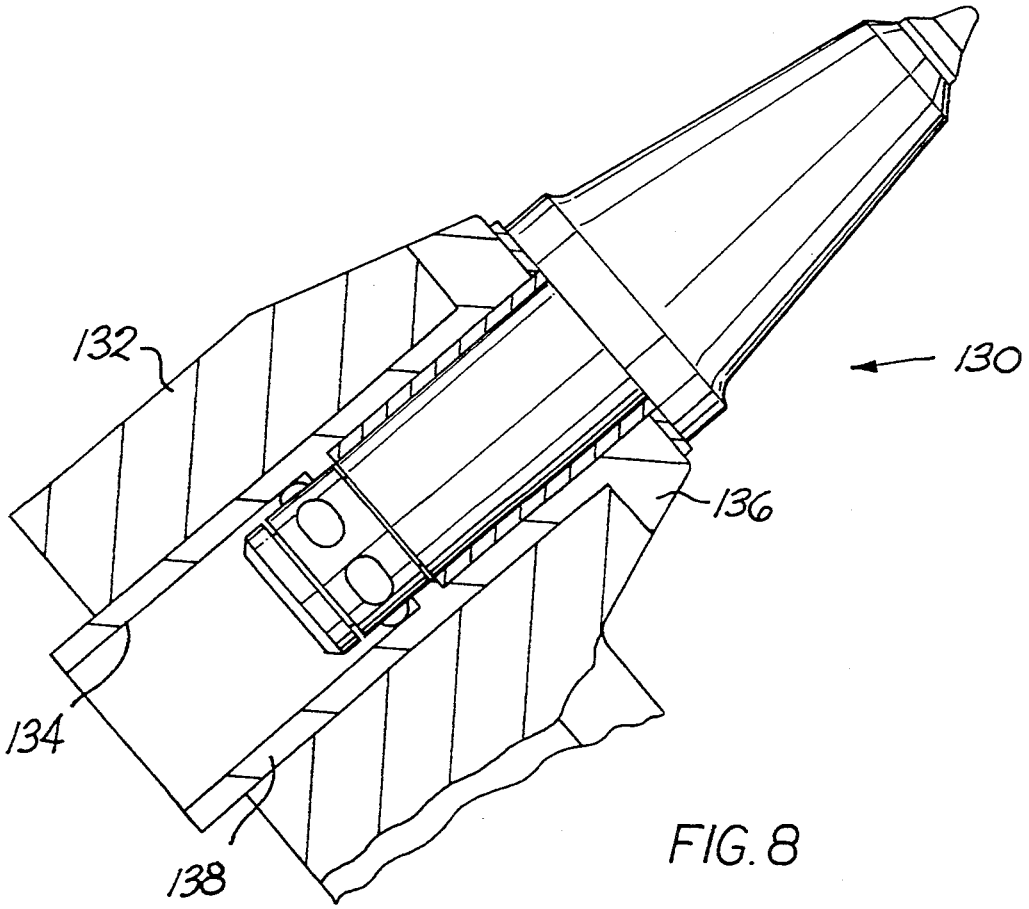
FIG. 8 is a side view of another embodiment of the rotatable cutting bit and bit holder assembly of the invention wherein the sleeve, the washer, and a portion of the bit holder assembly are shown in cross-section.

Referring to FIG. 8, there is illustrated another embodiment of a rotatable cutting bit-bit holder arrangement. This embodiment is similar to that of FIG. 3, except that the thickness of the bushing is less than the bushing of the embodiment of FIG. 3. This embodiment clearly shows an increase in the volume of material in the support block which supports the cutting bit.

The cutting bit is generally designated as 130. Cutting bit 130 is structurally identical to cutting bit 36 of FIG. 3 so that further description with reference numbers is not necessary. The support block 132 contains a bore 134 which receives a bushing 136. Bushing 136 has a side wall 138 which is thinner than the side wall of bushing 78 of FIG. 3 so that there is a greater volume of material in support block 132 to support the cutting bit than in support block 70 of FIG. 3. The volume of material comprising the total bit support, which is the combination of the support block and the bushing, remains the same for the embodiment of FIG. 8 as for the embodiment of FIG. 3.

Other specific embodiments of the invention will be apparent to those skilled in the art from a consideration of this specification or practice of the invention disclosed herein. It is intended that the specification and specific embodiments be considered as exemplary only, with the true scope and spirit of the invention being indicated by the following claims.

What is claimed is:

1. A rotatable cutting bit for insertion into the bore of a bit holder, the rotatable cutting bit comprising:

a bit body having opposite forward and rearward ends, a hard insert at the forward end of the bit body, an enlarged diameter portion mediate of the forward and the rearward ends of the bit body, said enlarged diameter portion defining an axially rearwardly facing shoulder, the bit body having a shank axially rearwardly of the shoulder, and the shank containing a reduced diameter portion near the rearward end of the body;

a rotatable sleeve carried on the shank, said sleeve surrounding the shank between the shoulder and the reduced diameter portion;

a rotatable washer carried on the shank adjacent the shoulder of the bit body; and a keeper ring being captive within the reduced diameter portion of the shank.

2. The rotatable cutting bit of claim 1 wherein said sleeve is cylindrical.

3. The rotatable cutting bit of claim 1 wherein said sleeve is softer than the bit body.

4. The rotatable cutting bit of claim 1 wherein said washer is softer than said bit body.

5. The rotatable cutting bit of claim 1 wherein the washer is flat.

6. The rotatable cutting bit of claim 1 wherein said sleeve has opposite axially forward and rearward ends, the axially forward end of the sleeve abutting the shoulder of the bit body.

7. The rotatable cutting bit of claim 6 wherein the washer includes a central aperture, and the sleeve passing through the aperture.

8. The rotatable cutting bit of claim 1 wherein upon the insertion of the cutting bit within the bore of the bit holder, the sleeve and the washer are each rotatable relative to the bit body and the bore.

9. The rotatable cutting bit of claim 1 wherein the keeper ring includes at least one radially outwardly extending protrusion.

10. A rotatable cutting bit and bit holder assembly comprising:

a bit holder having a bore with axially forward and rearward ends, the bit holder having a front face surrounding the axially forward end of the bore;

a rotatable cutting bit comprising:

a body having opposite forward and rearward ends, a hard insert at the forward end of the body, an enlarged diameter portion mediate of the forward and the rearward ends of the body, said enlarged diameter portion defining an axially rearwardly facing shoulder, the body having a shank axially rearwardly of the shoulder, and the shank containing a reduced diameter portion near the rearward end of the body;

a rotatable cylindrical sacrificial sleeve carried on the shank, the sleeve being rotatable with respect to the bit holder and the rotatable cutting bit;

a rotatable flat sacrificial washer carried on the shank, the washer being rotatable with respect to the bit holder and the rotatable cutting bit; and a keeper ring rotatably captive within the reduced diameter portion of the shank, and the keeper ring engaging the bit holder so as to rotatably retain the rotatable cutting bit within the bore of the bit holder.

11. The cutting bit holder assembly of claim 10 wherein the bit holder includes a radially inwardly projecting abutment within the bore thereof.

12. The cutting bit holder assembly of claim 11 wherein the keeper ring has at least one radially outwardly projecting protrusion, and the keeper ring protrusion engages the abutment in the bore of the bit holder.

13. The cutting bit holder assembly of claim 11 wherein the sleeve is captive between the shoulder of the bit body and the abutment.

14. The cutting bit-bit holder assembly of claim 11 wherein the abutment is annular about the circumference of the bore.

15. The cutting bit holder assembly of claim 10 wherein the washer is held captive between the front face of the bit holder and the shoulder of the body.

16. The cutting bit holder assembly of claim 10 wherein the bit holder includes:

a support block with a block bore wherein the block bore has opposite axially forward and rearward ends, an axially forward face surrounds the block bore opening at the forward end thereof;

a bushing with a bore wherein the bushing bore has opposite axially forward and rearward ends, a radially outwardly projecting flange at the axially forward end of the bushing bore, an axially forward bushing face surrounds the bushing bore opening at the forward end thereof; and the bushing being within the block bore whereby the bushing flange rests against the axially forward face of the block.

17. The cutting bit holder assembly of claim 16 wherein the shank of the cutting bit is within the bushing bore.

18. The cutting bit holder assembly of claim 16 wherein the bushing bore contains an abutment.

19. The cutting bit holder assembly of claim 18 wherein the sleeve is captive between the abutment and the washer, and freely rotatable on the shank.

20. A rotatable cutting bit and bit holder assembly comprising:

a bit holder having a bore with opposite axially forward and rearward ends, the bit holder having a front face surrounding the axially forward end of the bore;

a rotatable cutting bit comprising:

a body having opposite forward and rearward ends, a hard insert at the forward end of the body, an enlarged diameter portion mediate of the forward and the rearward ends of the body, said enlarged diameter portion defining an axially rearwardly facing shoulder, the body having a shank axially rearwardly of the shoulder, and the shank containing a reduced diameter portion near the rearward end of the body;

a freely rotatable protector carried on the shank, the protector being rotatable with respect to the bit holder and the rotatable cutting bit;

the protector having a sleeve portion surrounding a portion of the shank of the body, and the protector further including a washer portion sandwiched between the shoulder and the axially forward face of the bit holder; and a keeper ring rotatably captive within the reduced diameter portion of the shank, and the keeper ring engaging the bit holder so as to rotatably retain the rotatable cutting bit within the bore of the bit holder.

21. The cutting bit-bit holder assembly of claim 20 wherein the protector is one piece.

22. The cutting bit-bit holder assembly of claim 20 wherein the protector comprises a discrete sleeve and a discrete washer.

23. A bushing for insertion into the bore of a support block and for holding a rotatable cutting bit with a shank that carries a retainer and a sleeve, the bushing comprising:

an elongate bushing body containing a bushing bore therein;

the bushing bore having an abutment projecting radially inwardly therein; and upon the positioning of the cutting bit within the bushing bore, the abutment engaging the retainer so as to retain the cutting bit within the bushing bore and the abutment engaging the sleeve so as to restrict the axially rearward movement of the sleeve.

24. The bushing of claim 23 wherein the bushing bore has axially forward and rearward ends, and the abutment being mediate of the axially forward and rearward ends of the bushing bore.

25. A one-piece protector for carriage by the elongate shank of a rotatable cutting bit having an axially rearward end and which is within the bore of a bit holder, the protector comprising:

an integral sleeve portion surrounding a portion of the shank of the cutting bit, the sleeve portion being freely rotatable with respect to the bit holder and the cutting bit, the sleeve portion providing a barrier between the bit holder and the cutting bit so as to reduce wear on the bore of the bit holder, and the sleeve portion providing two surfaces of rotation between the cutting bit and the bit holder; and an integral washer portion adjacent the face of the bit holder defining the forward mouth of the bore, the washer portion being freely rotatable with respect to the bit holder and the cutting bit, the washer portion providing a barrier between the bit holder and the cutting bit so as to reduce wear on bit holder, and the washer portion providing two surfaces of rotation between the cutting bit and the bit holder.

26. The protector of claim 25 wherein the sleeve portion has a longitudinal axis and an axially forward end, and the washer portion extends radially outwardly from the sleeve portion at the axially forward end thereof.

27. The protector of claim 25 wherein the axial length of the sleeve portion is less than the axial length of the shank.

28. The protector of claim 25 wherein the sleeve portion extends short of the axially rear end of the shank.

29. A protector assembly for providing a barrier between a rotatable cutting bit having a shank carrying a retainer and a bit holder containing a bore and having an axially forward face, the protector assembly comprising:

a discrete sleeve surrounding at least a portion of the shank axially forwardly of the retainer, the sleeve being freely rotatable with respect to the bit holder and the cutting bit, the sleeve providing a barrier between the bit holder and the cutting bit so as to reduce wear on the bore of the bit holder, and the sleeve providing two surfaces of rotation between the cutting bit and the bit holder; and a discrete flat washer adjacent to at least a portion of the axially forward face of the bit holder, the washer being freely rotatable with respect to the bit holder and the cutting bit, the washer providing a barrier between the bit holder and the cutting bit so as to reduce wear on bit holder, and the washer providing two surfaces of rotation between the cutting bit and the bit holder.

30. The protector assembly of claim 29 wherein the sleeve has an axially forward end, and the washer abuts the axially forward end of the sleeve.

* * * * *